US006043779A

United States Patent [19]

Lalezari et al.

[11] Patent Number: 6,043,779

[45] Date of Patent: Mar. 28, 2000

[54] ANTENNA APPARATUS WITH FEED ELEMENTS USED TO FORM MULTIPLE BEAMS

[75] Inventors: Farzin Lalezari, Boulder; P. Keith Kelly, Lakewood; Leo Diaz, Golden, all of Colo.

[73] Assignee: Ball Aerospace & Technologies Corp., Broomfield, Colo.

[21] Appl. No.: 09/266,704

[22] Filed: Mar. 11, 1999

[51] Int. Cl.[7] ..... H01Q 3/22; H01Q 3/26

[52] U.S. Cl. ..... 342/371; 342/372; 342/373

[58] Field of Search ..... 342/368, 371, 342/372, 373; 343/756, 755, 753, 783, 909, 912

[56] References Cited

U.S. PATENT DOCUMENTS

| | | | |
|---|---|---|---|
| 3,852,762 | 12/1974 | Henf et al. | 343/756 |
| 4,100,548 | 7/1978 | Hemmi et al. | 343/837 |
| 4,123,759 | 10/1978 | Hines et al. | 343/876 |
| 4,297,710 | 10/1981 | Dupressoir | 343/756 |
| 4,445,119 | 4/1984 | Works | 343/377 |
| 4,489,325 | 12/1984 | Bauck et al. | 343/373 |
| 4,535,338 | 8/1985 | Ohm | 343/781 |
| 4,578,680 | 3/1986 | Haupt | 343/703 |
| 4,791,421 | 12/1988 | Morse et al. | 342/368 |
| 4,814,773 | 3/1989 | Wechsberg et al. | 342/368 |
| 4,825,216 | 4/1989 | Dufort | 342/376 |
| 4,845,507 | 7/1989 | Archer et al. | 343/754 |
| 4,975,712 | 12/1990 | Chen | 343/754 |
| 5,128,682 | 7/1992 | Kruger | 342/153 |
| 5,142,290 | 8/1992 | Dufort | 342/372 |
| 5,146,230 | 9/1992 | Hules | 342/374 |
| 5,274,381 | 12/1993 | Riza | 342/368 |
| 5,434,575 | 7/1995 | Jelinek et al. | 342/365 |
| 5,576,721 | 11/1996 | Hwang et al. | 343/753 |
| 5,581,260 | 12/1996 | Newman | 342/374 |
| 5,666,123 | 9/1997 | Chrystie | 342/373 |

OTHER PUBLICATIONS

Award/contract Issued by Electronic Systems Center/PKR Involving contractor Ball Aerospace and Technologies Corp and which is signed by Allen B Lundberg of BATC, have a signature date of Sep. 7, 1997 and which is not signed by the United States of America.

Award/contract issued by Electronic Systems Center/PKR Involving contractor BATC signed by mr. Lundberg on Nov. 22, 1996 and signed by Robert Tyrrell representing the USA and signed on Nov. 25, 1996 and Including a letter having a mailing date of Nov. 26, 1996 to BATC from Mr Flaherty of the Department of the Air Force.

Proposal for lightweight X–Band Antenna System BAA–96–02, Mar. 1966 Reference Antenna systems prepared for Rome Laboratory of Hanscom, AFB. MA and prepared by Bell Telecommunications Products Division of BATC and having a date of Sep. 1996.

Proposal for lightweight X–Band SAR Antenna System prepared for U S Air Force of Rome laboratory and prepared by Ball Telecommunication Products Division of BATC and having a date of May 1997.

*Primary Examiner*—Thomas H. Tarcza
*Assistant Examiner*—Dao L. Phan
*Attorney, Agent, or Firm*—Sheridan Ross P.C.

[57] ABSTRACT

An antenna apparatus for generating transmit signals, receiving return signals based on the transmit signals, and/or receive transmitted signals from other sources is provided. The antenna apparatus includes a beam forming system and a beam collimating system. The beam forming system includes an array of feed elements. Each feed element can be used to generate more than one primary beam, either substantially at the same time or at different times. A secondary beam is developed from the primary beam using the collimating system. The secondary beam constitutes the transmit signal. The feed elements have relatively low gain, the spacing between them is no greater than about one wavelength, and they are relatively small in size to reduce beam-to-beam cross over loss. The beam forming system also includes a control system for energizing different feed elements using the same transmit/receive modules.

33 Claims, 7 Drawing Sheets

ANTENNA APPARATUS WITH FEED ELEMENTS USED TO FORM MULTIPLE BEAMS

FIELD OF THE INVENTION

The present invention relates to an antenna apparatus and, in particular, an antenna apparatus that generates multiple beams at either the same time or different times using one or more of the same feed elements.

BACKGROUND OF THE INVENTION

Antenna array systems for transmitting/receiving data or other information have been devised in a variety of configurations. Phased array antenna systems require numerous and costly components that contribute to a design complexity that may not be acceptable or appropriate for certain applications. In generating transmitted signals using a phased array antenna system, it is commonplace to create a scanning beam or signal in which the beam or signal changes its direction in predetermined increments in one or both of azimuth and elevation.

A transmitted beam or signal can also be developed using antenna arrays in which the collimating surface is parabolic, cylindrical in one direction or where waveguides are employed, such as the pillbox antenna array. With respect to the pillbox antenna array, it is known to apply radio frequency (rf) energy to the pillbox antenna array by means of relatively large-in-size feed horns. For a particular beam to be generated and applied to the pillbox antenna array, one or more dedicated feed horns are activated to form the particular beam. The same feed horn is not utilized in generating different beams for use by the pillbox antenna array.

Phased array antenna systems and other antenna systems have been used in wide and varied applications including locating them in orbit above the earth's surface. Such antennas are useful in obtaining desired information related to what is present or occurring at an instance in time at a particular geographic location. In that regard, such antenna systems can be designed to scan geographic areas as they orbit about the earth. Ideally, in obtaining such information, in scanning between immediately adjacent geographic locations, it is advantageous that such a scan result in obtaining all desired information from the earth's surface, while avoiding loss of information due to incremental changes in the direction of the transmitted signal from the antenna. Loss of such information is commonly the result of high beam-to-beam cross over loss, which refers to insufficient signal overlap between successively transmitted scanning beams or signals.

When evaluating the placement of an antenna system in orbit, an important factor is the weight or payload associated with such an antenna system. It is highly advantageous to keep the weight as low as feasible. With respect to phased array antenna systems, they tend to be not only relatively expensive, but suffer weight penalties based on high density of electronic components. Consequently, it is much more costly to transport such a payload into orbit.

Based on the need for a highly accurate and less costly antenna system, it would be beneficial to be able to place into earth's orbit a relatively compact, lightweight and inexpensive antenna apparatus that can transmit/receive signals containing useful information from identifiable areas along the earth's surface, while reducing high beam-to-beam cross over loss. Additionally or alternatively, it would be advantageous to generate a plurality of transmitted or received signals in which one or more of the feed elements that are utilized to provide such signals are not dedicated to producing a particular beam or signal.

SUMMARY OF THE INVENTION

In accordance with the present invention, an antenna apparatus is disclosed that can generate multiple beams, either simultaneously or at different times, which constitute transmitted signals for obtaining useful information. The antenna apparatus includes a beam collimating system and a beam forming system in communication therewith. The beam forming system is particularly characterized by a number of feed elements in which two or more of them are energized at the same time to generate a primary beam. The feed elements are arranged in an array defined by a number of rows and columns. The dimensions and direction of the primary beam are regulated by selective activation of the two or more feed elements.

In forming a primary beam or primary beams, the beam forming system also includes a phase shifter circuit that controls activation of feed elements in respect to generation of one or more primary beams in azimuth. In one embodiment, a primary beam translates in the azimuth direction due to control of the phase shifter circuit and selective activation of those feed elements along the rows of the feed element array.

The beam forming system also includes, in one embodiment, a plurality of transmit/receive (T/R) modules having outputs for use in energizing the two or more selected feed elements. The T/R modules may be electronically coupled to the phase shifter circuit. A number of network switch elements are responsive to such outputs from the T/R modules. The network switch elements are electronically controlled, by means of a controller that includes a programmable processor. Each of the network switch elements is electrically connectable to a set of the number of feed elements. At any instance in time, each of the network switch elements provides electrical communication between a T/R module and only one of the feed elements in the set to which the particular switch element is connectable. Hence, the same T/R module can be used to energize more than one feed element in the same set, but only at different times.

With regard to the feed elements of the feed element array located in columns of the array, they are selectively energized to form the primary beam in elevation. The feed elements in a particular column can be selectively activated in a sequential manner in order to generate a translating beam in elevation. For example, two or more feed elements in a column of the feed element array can be activated to generate a primary beam. Then, an immediately adjacent feed element can be activated, while a previously activated feed element is de-activated, with this de-activated feed element being located at the opposite end of the column of activated feed elements from the newly activated feed element. This process can continue to produce in elevation the translating primary beam.

Although the feed elements may assume different configurations and geometries, such as monopoles, the majority of the feed elements, if not all of them, must meet certain key requirements. The spacing between immediately adjacent feed elements (those feed elements that are right next to each other) must be no greater than about one wavelength. In one embodiment, the center frequency of the transmitted signal from the antenna apparatus is 10 GHz, together with the operational bandwidth being about 1.5 GHz and the instantaneous bandwidth being about 50 MHz. Such spacing between immediately adjacent feed elements is preferably about 0.5 wavelength. Similarly, the size or dimension(s) of feed elements must be limited. Preferably, the greatest lateral extent of such feed elements should be no greater than about one wavelength.

The primary beam that is generated by the beam forming system is applied to the beam collimating system. The beam collimating system functions to generate a secondary beam from the primary beam and directs it for transmission outwardly of the antenna apparatus as the transmitted signal. The beam collimating system includes, in one embodiment, a collimating member at one end of the antenna apparatus. The collimating member has a height that extends between its bottom end and its top end. The collimating member can also assume a number of configurations or geometries including a reflector, which may be a parabolic reflector, a parabolic cylindrical reflector, a lens or any other device that properly performs the main secondary beam function related to collimating the primary beam. The beam collimating system also may include, in one embodiment, a number of spaced, parallel waveguide members, with two adjacent waveguide members constituting a waveguide. In this embodiment, a plurality of antenna apertures are defined by the adjacent waveguide members and the spacing therebetween. Each of the waveguide members extends from a first end to a second end. The first end is adjacent to the antenna apertures from which the transmitted signals are directed. The second end is electrically continuous with the collimating member. The feed element array is disposed adjacent to the first or front end of the waveguides. The feed element array is arranged such that each column of the feed element array communicates with a different one of the waveguides. That is, only one column of the feed element array is aligned between or associated with two spaced, parallel waveguide members.

In another embodiment, the waveguide assembly or waveguides are not utilized. Instead, a collimating member of sufficient length is employed, which length is typically greater than the length of the collimating member that is provided in the embodiment having waveguides. The length of the collimating member, such as a reflector or lens, is a function of its focal length (f), and the array length (AL) or width of the feed element array and the scan range along the length of the array.

The antenna apparatus also has a focal length. The focal length is defined as the length or distance from the collimating member adjacent its bottom end to the feed element array adjacent its center. A ratio or relationship is definable using the focal length (f) and the height (D) of the collimating member. More specifically, a ratio of f/D is defined that should have a value in the range of about 0.5 to about 1.5 and preferably about 1.0. If the ratio is greater than this preferred range, the feed elements become too large in size. At least the majority of the feed elements, if not all of them, should have a gain no greater than about 6 db. Conversely, when the ratio is less than the preferred range, unacceptable or very poor scan performance results. That is, when the primary beam is steered, the performance thereof may unacceptably deteriorate if the ratio is less than the preferred ratio.

With respect to using the antenna apparatus, two or more feed elements are energizable to form two or more primary beams. In one mode of operation, the two or more primary beams are part of a translating primary beam, which is produced due to selective activation/deactivation of adjacent feed elements. In such a case, essentially one primary beam is generated at any instance in time. In another mode of operation, more than one primary beam is generated at any instance in time, with at least one feed element of the feed element array being energized for use in generating two of such simultaneously generated primary beams.

More particularly, with respect to generating a translating primary beam to produce a scanning secondary beam, such scanning can occur in one or both of the azimuth and elevation directions. In connection with elevation scanning, at opposite ends of the currently energized feed elements in the same column, one of such feed elements is de-activated and a feed element immediately adjacent a currently activated feed element is energized. In conjunction with scanning in azimuth, similar turning on/turning off of feed elements is accomplished using the same row of the feed element array. Particularly with regard to scanning in elevation, the beam-to-beam cross over loss associated with successive secondary beams is substantially reduced. Ideally, successively transmitted signals to adjacent locations, for example on the earth's surface, provide complete coverage so that there is no loss of useful information due to beam-to-beam cross over loss.

When it is desired to use the mode of operation in which two transmitted beams or signals are output by the antenna apparatus, at least one of the feed elements used in generating the transmitted signals is the same. For example, when obtaining information regarding locations on the earth's surface, useful information can be obtained using two or more such transmitted signals since they may provide different views or perspectives of the same or closely adjacent locations. Relatedly, steering of two or more secondary beams in connection with outputting the two or more transmitted signals can also be accomplished in order to receive desired information by the antenna apparatus for subsequent processing. Additionally, by controlling the activation of feed elements, the beam width associated with the antenna system is regulated. By way of example, when a relatively few number of feed elements are activated, a relatively narrow secondary beam is produced from a relatively wide primary beam. Conversely, when a relatively greater number of feed elements are activated, a relatively wide secondary beam is produced from a relatively narrow primary beam.

Based on the foregoing summary, a number of salient aspects of the present invention are noted. An antenna apparatus is provided that can generate multiple beams, either at different times or at the same time, using one or more of the same feed elements. Unlike phased array antenna systems, fewer components are required and there is a significant reduction in cost. Unlike more mechanically controlled antenna systems, the antenna apparatus of the present invention is lightweight and more rapidly responds to transmitted/received signals. The feed elements of the feed element array have relatively lower gain, are spaced from each other at short distances and are relatively small in size, which not only results in a lower cost antenna apparatus, but also reduces beam-to-beam cross over loss associated with elevational scanned signals. Further contributing to cost reduction and fewer components is the combination of transmit/receive modules and network switch elements, which combination enables the number of such transmit/receive modules to be substantially less than the number of feed elements since different feed elements can be energized by the same transmit/receive module. As an overview, the combination of the beam forming system and the beam collimating system of the present invention is rapidly responsive to generating new or scanning secondary beams, as well as achieving a lightweight antenna apparatus that facilitates its transport and deployment in space above the earth's surface.

Additional advantages of the present invention will be become readily apparent from the following discussion, particularly when taken together with the accompanying drawings.

DETAILED DESCRIPTION

Figure 1:
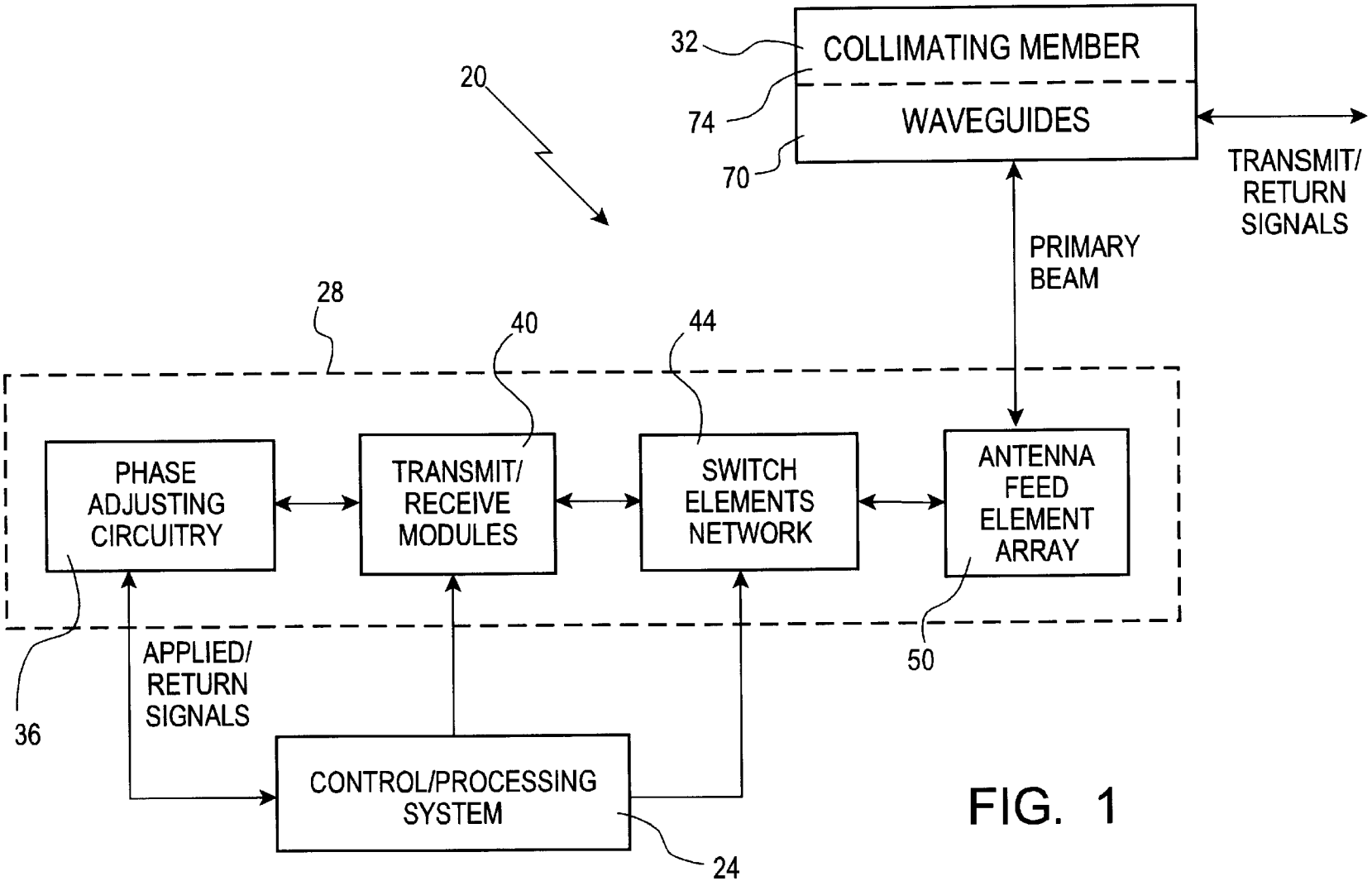
FIG. 1 is a block diagram of major components of an antenna apparatus of the present invention.

With reference to FIG. 1, a block diagram of the antenna apparatus is depicted. The antenna apparatus 20 includes a control/processing system 24 having processing hardware and software for controlling operations and processing data and other information that the antenna apparatus 20 receives based on a previously generated transmit signal. The control/processing system 24 communicates directly with a beam-forming system 28 that generates one or more primary beams, either simultaneously or at different times. Each primary beam is directed to a beam collimating system 32. A secondary beam is developed by the beam collimating system 32 using the primary beam or beams applied thereto. The secondary beam constitutes the transmit signal in the form of an rf signal or rf energy that is directed to a predetermined location for obtaining information at or about that location. In one embodiment, the antenna apparatus 20 is placed into orbit about the earth. The antenna apparatus 20 is able to deliver a transmit signal to a desired location on the earth's surface.

Generally, the antenna apparatus 20 globally transmits/receives signals relative to predetermined or desired areas or locations. The area of current interest depends on the location of the antenna apparatus 20, such as when orbiting about the earth, the current location of the antenna apparatus 20 in its orbit. The generation of transmit signals constituting outputs from the antenna apparatus 20 can be accomplished with a number of modes of operation. In a first mode of operation, the antenna apparatus 20 outputs a scanning transmit signal that scans the area(s) or location(s) of interest. Using this mode, no unacceptable losses of available information between scanning signals occurs because of the sufficient overlap between successive signals that are part of the scanning transmit signal. In a second mode of operation, more than one transmit signal is sent by the antenna apparatus 20 at essentially the same time.

In conjunction with such modes of operation, to generate a primary beam that subsequently results in a transmit signal output from the antenna apparatus 20, the antenna apparatus 20 further includes phase adjusting circuitry 36, a transmit/receive assembly having a number of transmit/receive (T/R) modules 40, a switch elements network 44 and an antenna feed element array 50. The phase adjusting circuitry 36 is primarily involved with controlling or causing desired positioning of the primary beam in the azimuth direction. Under control of the control/processing system 24, an applied signal is received by the phase adjusting circuitry 36 and it outputs a phase control signal related to which feed elements of the antenna feed element array 50 are energized or activated to achieve the desired azimuth direction of the particular primary beam. The antenna feed element array 50 can be defined as including a number of feed elements arranged in rows and columns, with the azimuth direction of the particular beam that is being generated being a function of the phase gradient placed on the row or rows having the feed elements that are currently being activated. The phase control signal from the phase adjusting circuitry 36 is applied to the transmit/receive modules 40. The outputs from the T/R modules 40 constitute properly conditioned signals, such as with sufficient amplification, for subsequently energizing the selected feed elements of the feed element array 50. Such properly conditioned signals are first received by the switch elements network 44, which includes a number of switch elements that are configured to communicate with each of the feed elements of the feed element array 50. Accordingly, the conditioned or amplified signals for energizing the feed elements are properly channeled to the desired feed elements. In that regard, the control/processing system 24 outputs switch control signals that are used to open or close, whichever is applicable for the particular primary beam to be generated, the selected switch elements so that the conditioned or amplified energizing signal from the T/R modules 40 are applied to the selected feed element or elements of the feed element array 50.

The selective activation of T/R modules 40 and control of the switch elements in the switch element network 44 by the control/processing system 24 selectively energizes feed elements to achieve primary beam generation in the elevational direction. That is, feed elements that are disposed in the same column of the feed element array 50 are selectively energized to produce a primary beam that can vary along an elevational plane. In connection with scanning in the elevational direction, two or more feed elements in the same column of the feed element array 50 can be turned on to generate a primary beam and then successive or immediately adjacent feed elements in the same column of the feed element array 50 can be turned on, while previously activated feed elements are turned off. For example, scanning in the elevational direction is conducted by turning on one feed element that was previously not energized and another feed element, in the same column that was previously energized and is the farthest away from th e newly activated feed element, is turned off. This procedure involving the turning on/turning off of the feed elements in the same column can continue to achieve a desired elevational scan or steering of the primary beam.

Figure 2:
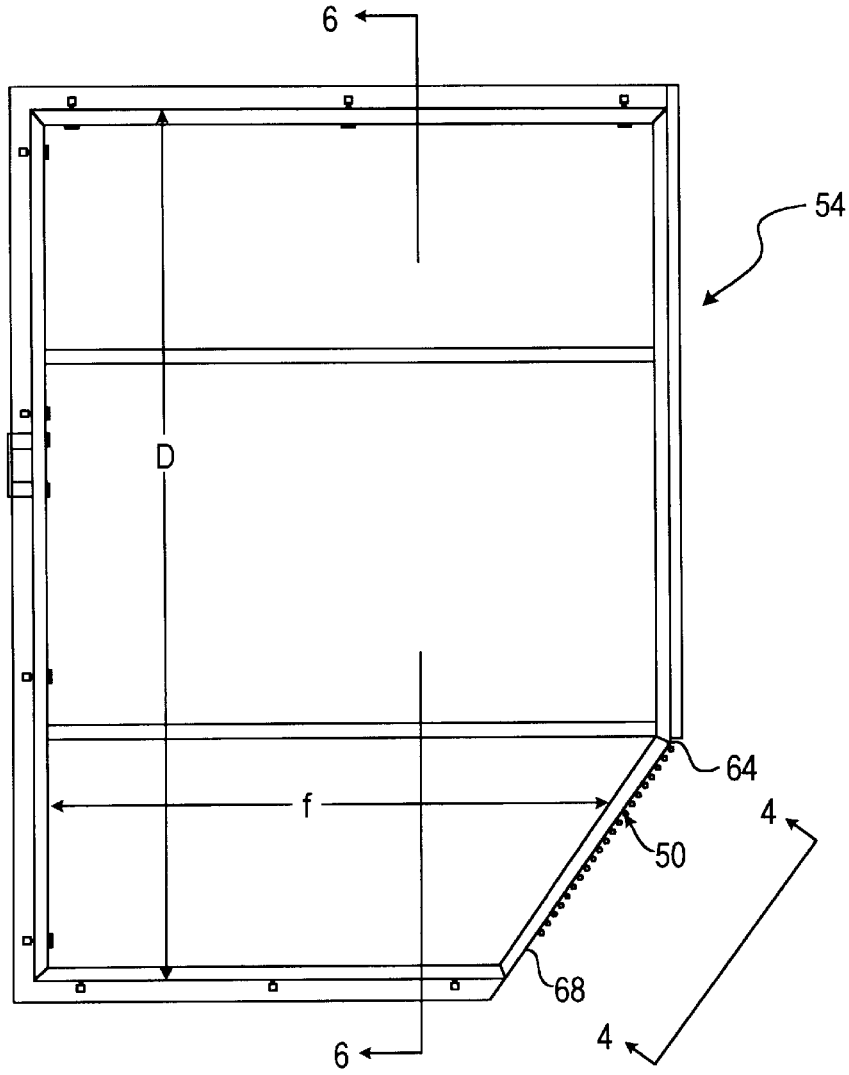
FIG. 2 is a side elevational view illustrating a frame assembly of the antenna apparatus and with a column of feed elements schematically illustrated.
Figure 3:
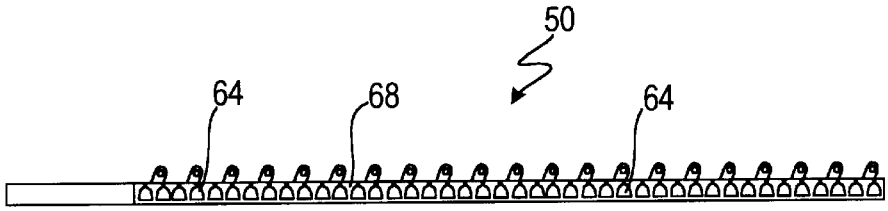
FIG. 3 is a top view of one column of feed elements.
Figure 4:
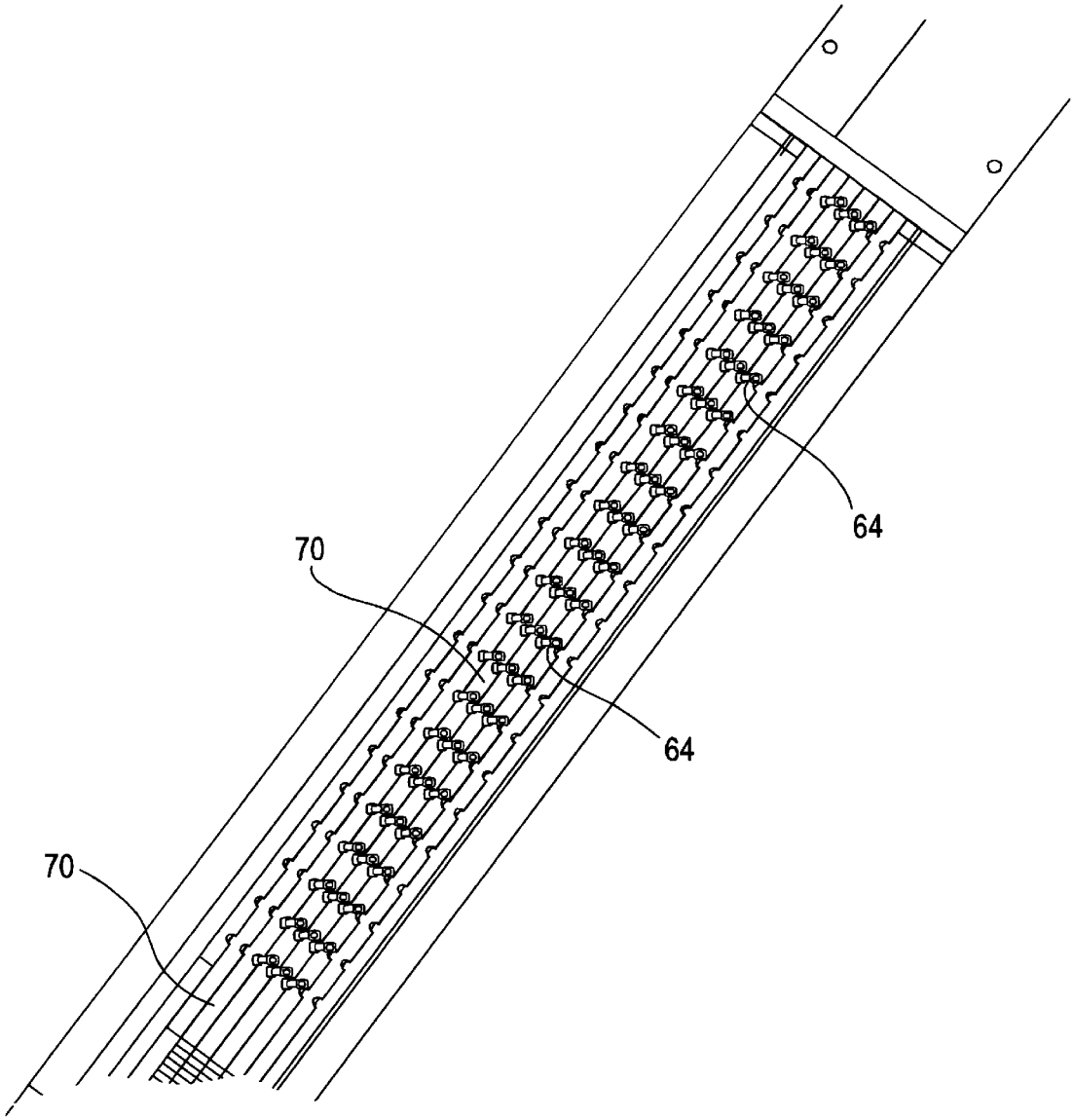
FIG. 4 is an end view, taken along lines 4—4 of FIG. 2, illustrating an embodiment of the antenna apparatus in which there are 7×22 feed elements in the array.
Figure 5:
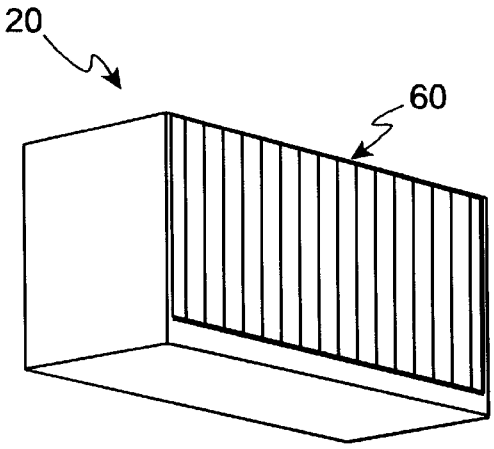
FIG. 5 is schematic, perspective illustration of a box kite configuration of the antenna apparatus.

With regard to further details directed to an embodiment of the feed elements of the feed element array 50, reference is made to FIGS. 2–4. FIG. 2 illustrates one embodiment of a frame assembly 54 of the antenna apparatus 20 for supporting the feed element array 50. The structural configuration of the frame assembly 54 can be part of a box-kite design 60 as illustrated in FIG. 5, which schematically depicts this form of antenna apparatus 20. The frame assembly 54 has the feed element array 50 connected thereto adjacent a bottom end thereof. One column of the feed elements 64 of the feed element array 50 is shown. In this embodiment, each column including the illustrated column has the number of feed elements equal to 21, although greater or fewer numbers of feed elements 64 could be utilized. The number of feed elements in the column constitutes the number of rows in the feed element array 50. With reference to FIG. 3, one column of feed elements 64 for this embodiment is illustrated together with a support platform 68 for the feed elements 64. The number of columns of feed elements 64 in the feed element array 50 can vary. In one embodiment, with reference to FIG. 4, seven columns of feed elements 64 are illustrated thereby providing an array of 7 columns by 21 rows in the feed element array 50.

The feed elements 64 have certain key properties or parameters. The spacing between adjacent feed elements 64 in a particular column, as well as the spacing between the feed elements 64 in a particular row, are limited. Such spacing is preferably about 0.5 wavelength and should be in the range of about 0.5 wavelength–1.5 wavelengths. The size of at least a majority of the feed elements 64, particularly the lateral extents or widths of the feed elements 64, should also be in the same range as the spacing between such feed elements 64. Regarding the kinds or types of feed elements 64, they can be of different designs or configurations, such as monopoles, so long as they meet such size and spacing requirements. These requirements associated with the feed elements 64 are important in avoiding high beam-to-beam cross over loss, as will be discussed later herein when more information is provided concerning uses or operations of the antenna apparatus 20.

Returning to FIG. 1, the beam collimating system 32 of the antenna apparatus 20 is responsive to the primary beam that is generated and output by the beam forming system 28. The beam collimating system 32 develops the secondary beam from the primary beam. In one embodiment, the beam collimating system 32 includes a waveguide assembly comprised of a number of waveguides 70 that guide or direct the generated primary beam to a collimating member 74. In particular, the primary beam produced by the antenna feed element array 50 is directed through one or more of the waveguides 70 to the collimating member 74, which is located at the rear of the antenna apparatus 20. The secondary beam is reflected from the collimating member 74 and is directed generally opposite the direction of the primary beam through the waveguides 70 to the front of the antenna apparatus 20. The collimating member 74 can be any device that properly collimates the primary beam to develop the desired secondary beam for transmission from the antenna apparatus 20 as the transmit signal. In one embodiment, the collimating member 74 includes a reflector and preferably a parabolic reflector. In another embodiment, the collimating member 74 includes a lens.

With reference to FIG. 2, the collimating member 74 in the form of a parabolic reflector is disposed within the frame assembly 54 and, when positioned therein, has certain dimensional properties or characteristics. That is, the collimating member 74 has a length or distance associated with it that extends from its lower or bottom end to its upper or top end. This length is defined as the distance (D). Additionally, the collimating member 74 in the form of a parabolic reflector has a focal length (f), which extends from the collimating member 74 to the feed element array 50. The focal length and the distance can be defined in terms of a ratio (f/D). In the preferred embodiment, f/D=about 1 and is in a range of about 0.5–1.5. This is preferred in maintaining a relatively compact and lightweight antenna apparatus 20 and this range of ratios is particularly achieved when using the smaller size feed elements 64 and the spacing therebetween.

Figure 7:
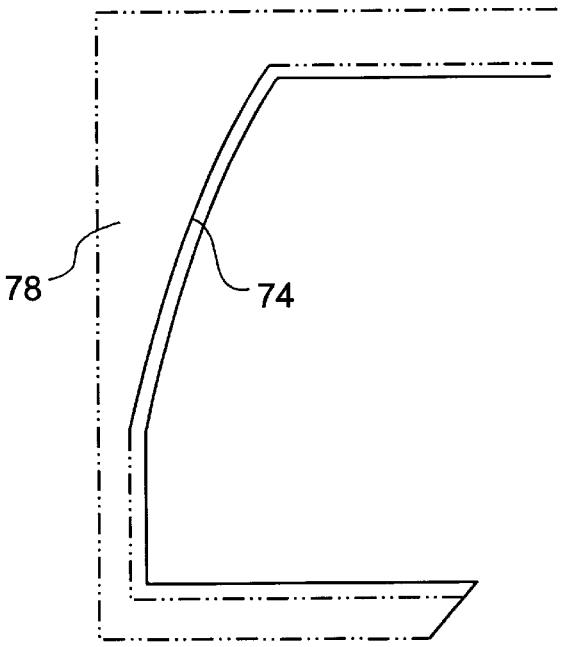
FIG. 7 is a side elevation view of an insert member having a geometric configuration corresponding to a parabolic reflector (collimating member)

With reference to FIG. 7, in one embodiment in which the collimating member 74 is a parabolic reflector, it can be joined to an insert member 78, which is disposed within the frame assembly 54 of the antenna apparatus 20. The insert member 78 is configured to readily adapt and receive the desired shape of the parabolic reflector 74.

With respect to the waveguides 70, each such waveguide is comprised of two waveguide members that are spaced from each other. Except for the waveguide members at the outer ends of the waveguide assembly, each waveguide member constitutes one of the waveguide members for two of the waveguides 70. The waveguide members have a trapezoidal shape when used with the parabolic reflector as a collimating member 74. In such an embodiment, each waveguide member has one side attached to the parabolic reflector 74 and the opposite side attached to the feed element array 50. More specifically, each waveguide member is electrically bonded to a side of adjacent feed elements and the parabolic reflector 74 is also electrically bonded to the waveguide members. In one embodiment, the waveguide members are made of metallized Mylar® sheets. In another embodiment, metallized "ripstop" Dacron fabric is employed. Such waveguide members have certain structural properties including being relatively thin but having sufficient rigidity to maintain a flat or planar configuration when the waveguides 70 are assembled to act as guides for the generated beams. Each waveguide 70, in combination with a section of the parabolic reflector 74 to which it is attached, constitutes a pillbox element and together define a pillbox antenna array.

Figure 6:
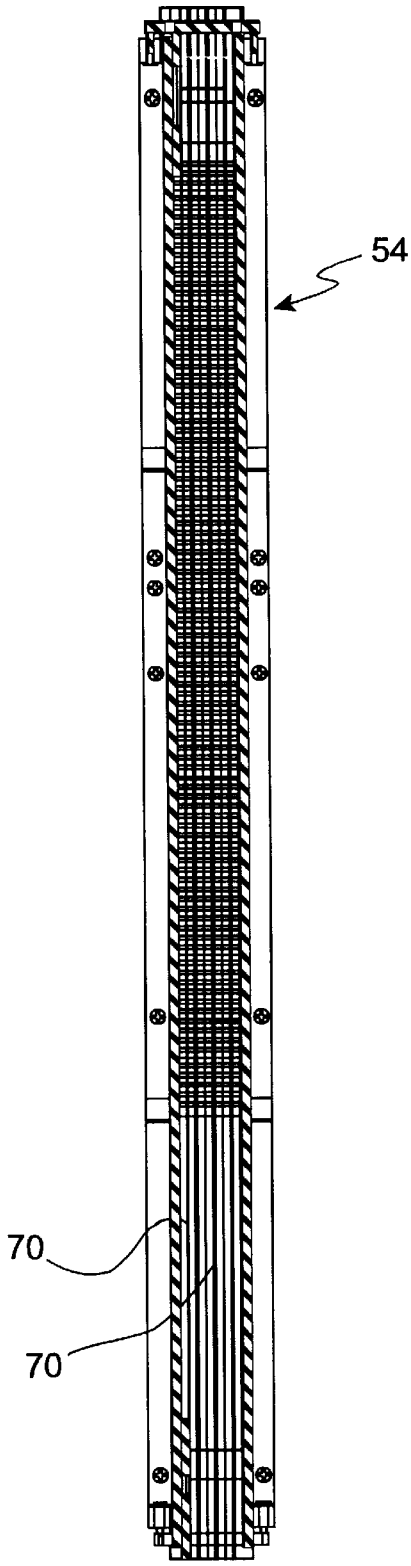
FIG. 6 is a longitudinal, cross-sectional view, taken along lines 6—6 of FIG. 2, illustrating the seven pillbox elements of the embodiment of FIG. 3.

With reference to FIG. 6, in the embodiment in which the feed element array 50 has an array of 7 columns×21 rows, there are seven waveguides 70 defined by a total of eight waveguide members. As can be appreciated, a greater or fewer number of waveguides 70 could be part of the antenna apparatus 20. However, the number of waveguides 70 is based on the feed element array 50, particularly the number of waveguides 70 being the same as the number of columns of feed elements 64 in the feed element array 50. In that regard, each column of feed elements 64 is aligned with the space between two waveguide members that constitute a particular waveguide 70. Accordingly, primary beam energy that is developed by one or more feed elements 64 in a particular column of the feed element array 50 is guided to the parabolic reflector 74 using the particular waveguide 70 in alignment with such feed element(s) 64.

Figure 8:
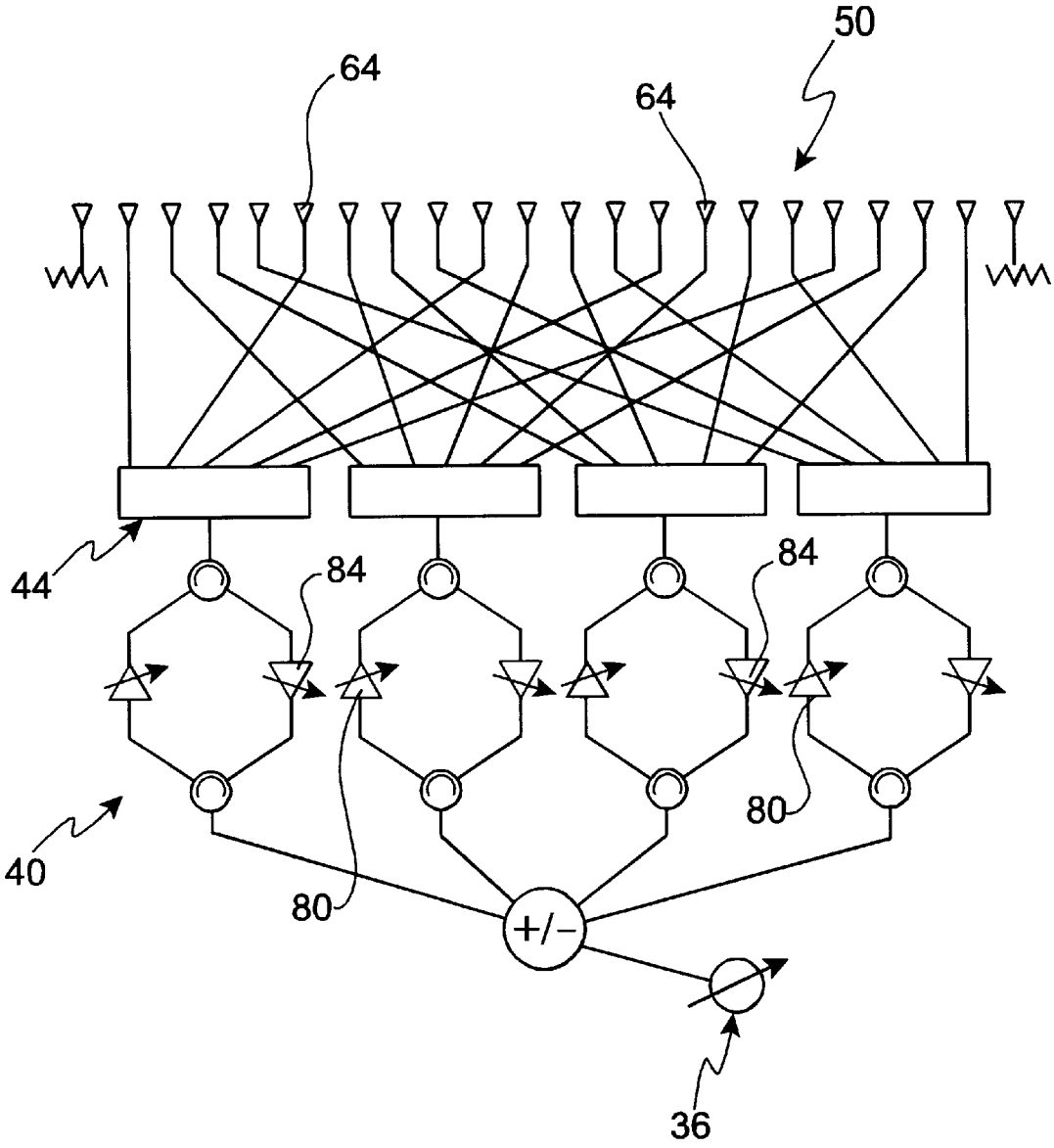
FIG. 8 schematically illustrates further details related to the combination of feed elements, network switch elements, T/R modules and a phase shifter circuit for one column (antenna aperture)

With reference to FIG. 8, a preferred embodiment is illustrated in more detail depicting the phase adjusting circuitry 36, the T/R modules 40 and the switch elements network 44 in selective communication with the antenna feed element array 50. In this embodiment, one column of feed elements 64 is illustrated in which the number of feed elements equals 22, with the end feed element not being active during a transmit mode when a primary beam is being generated. The phase adjusting circuitry 36 is a six-bit variable phase shifter for azimuth combining so that control for generation of the primary beam in the azimuth direction is achieved by the inputs applied thereto. The phase control signal from the phase adjusting circuitry 36 is applied to each of four T/R modules 40. Each of the four T/R modules 40 includes a variable gain high-powered amplifier (HPA) 80 that amplifies or otherwise conditions the signal applied to it in connection with outputting an energizing signal for subsequent application to a selected feed element 64. Each T/R module 40 also includes a low noise amplifier (LNA) 84 that is utilized when a return beam is being received by the antenna apparatus 20. Each T/R module 40 is electrically connected to one of the switch elements of the switch elements network 44. Consequently, in this embodiment, there are four switch elements in this part of the switch elements network 44. Each switch element is structured to provide, at any one time, electrical communication between a selected one of five switch output lines and a feed element 64. Each of the switch output lines is electrically connected to a switch element 64. When generating a primary beam, each switch element is selectively controlled to communicate the output from the T/R module 40 to the selected switch output line and, concomitantly, the feed elements 64 in a particular column, it is practically unnecessary to provide a separate T/R module for each feed element 64. Accordingly, fewer T/R modules 40 are required and one T/R module can be used with more than one feed element 64. In the illustrated embodiment, one T/R module 40 can be used to energize five different feed elements 64 using the switch elements network 44.

Figure 9:
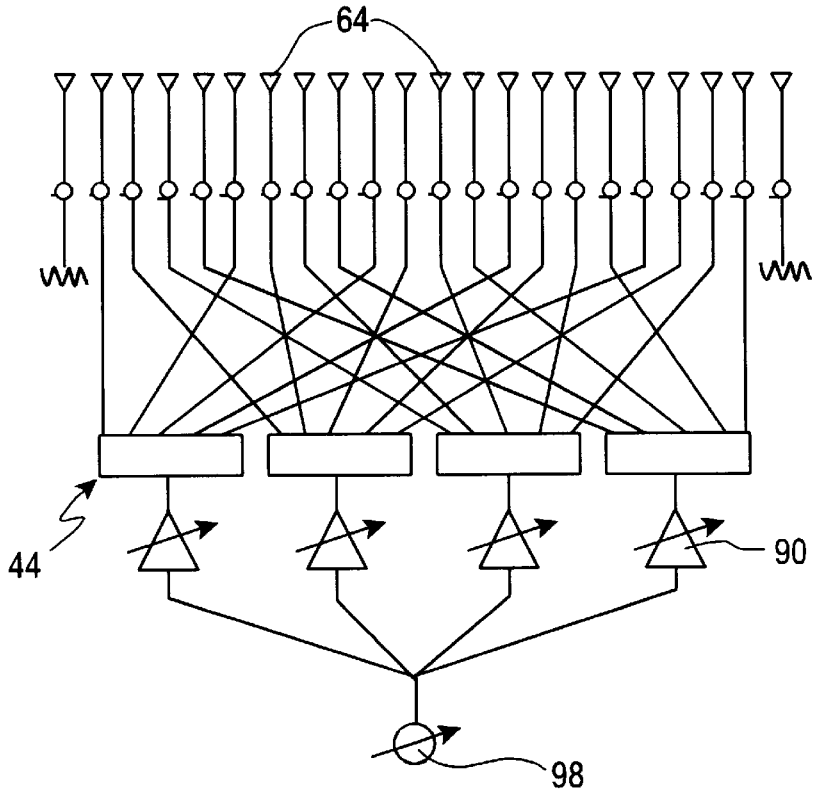
FIG. 9 schematically illustrates a transmit manifold of a second embodiment for use in energizing selected feed elements.
Figure 10:
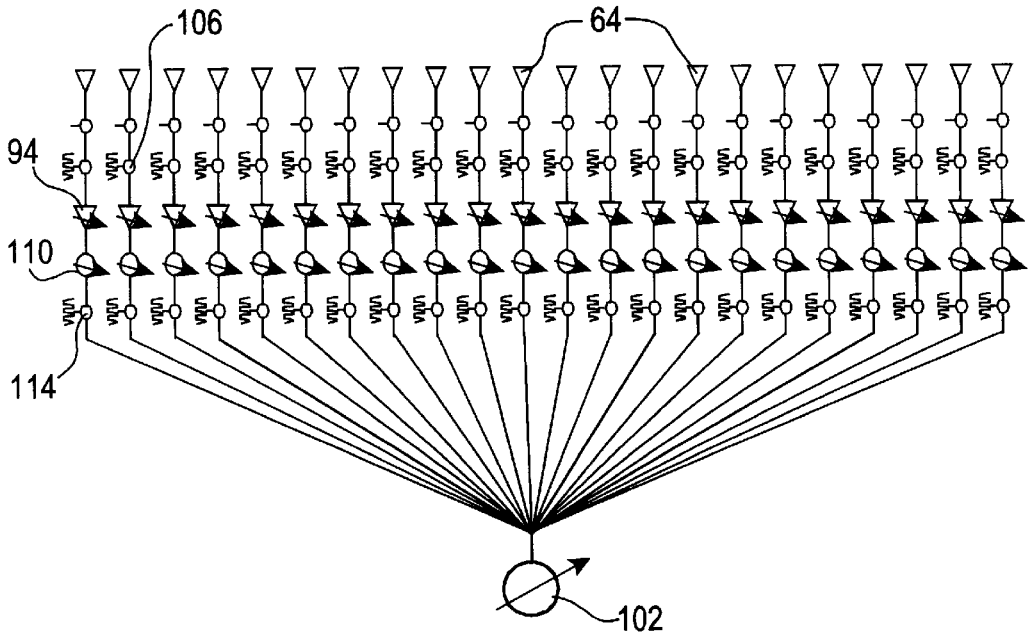
FIG. 10 schematically illustrates a receive manifold, separate from the transmit manifold, of a second embodiment.

With reference to FIGS. 9 and 10, another embodiment of phase adjusting circuitry 36, separate transmit and receive hardware in the form of four transmit elements 90 and twenty-two receive elements 94, and a switch elements network 44 that is operatively connected only to the feed elements of the antenna feed element array 50 in the transmit mode (when a primary beam is being generated) are illustrated. In this embodiment, the phase adjusting circuitry 36 includes a 6-bit phase shifter 98 whose output phase control signal is applied to each of the transmit elements 90. Like the embodiment of FIG. 8, each of the transmit elements is an HPA (high powered amplifier). The outputs of the HPAs are applied to the four switch elements of the switch elements network 44. Like the embodiment of FIG. 8, each of the switch elements is controlled using the control/processing system 24 to provide electrical communication between the output of the HPA 90 to which it is connected and a selected one of five switch output lines, each of which communicates with a different one of the feed elements 64 in the column of the feed element array 50.

The phase adjusting circuitry 36 for the receive mode includes a 6-bit phase shifter 102 that receives the outputs from the receive elements 94. In this embodiment, the receive elements 94 are made up of twenty-two LNAs. Instead of a switch elements network 44, each of the feed element outputs communicates with an isolator 106, with the output of the isolator providing an input to one of the receive elements 94. Any return signal received by each of the receive elements 94 is applied to the 6-bit phase shifter through a dedicated 1-bit phase shifter 110 and then through a dedicated isolator 114. As can be appreciated, this embodiment requires more components or parts than the embodiment of FIG. 8 and has a relatively greater implementation cost because of the larger number of components.

Figure 11:
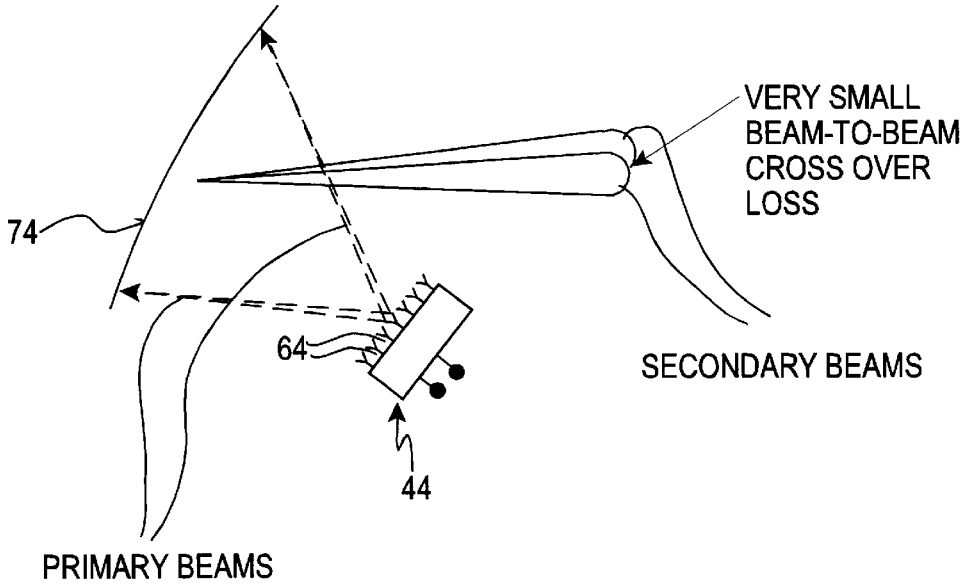
FIG. 11 schematically illustrates generation of successive transmit beams that achieve reduced beam-to-beam cross over loss.

More description related to the operation of the antenna apparatus 20 will now be provided, particularly with reference to FIG. 11. FIG. 11 schematically illustrates generation of primary and secondary beams that result in a scanning transmit signal with reduced beam-to-beam cross over loss. When the antenna apparatus 20 is operating in a scanning mode in which sequential information is to be obtained from continuous locations or areas without interruption, it is desired that no useful information be lost between successive transmit signals. As schematically illustrated in FIG. 11, successive transmit signals from the antenna apparatus 20 have sufficient overlap or continuity such that all useful or available information along a continuum is obtainable. This aspect is particularly advantageous when the antenna apparatus 20 is orbiting the earth's surface and transmit signals are continually output by the antenna apparatus for obtaining information related to what is present or what is occurring at any particular relatively small area or location.

With respect to generating such a scanning signal, the smaller-in-size and the short-spaced feed elements 64 are selectively activated to generate successive primary beams that result in the reduced beam-to-beam cross over loss. For example, in connection with the elevational direction, two or more feed elements of a first column of feed elements in the feed element array 50 are energized or activated using selected T/R modules 40 and switch elements in the switch elements network 44 that are operatively connected thereto under control of the control/processing system 24 to produce a first primary beam. Then, one of the feed elements 64 that is immediately adjacent to a currently activated feed element 64 is energized, while another currently activated feed element 64, which is located at the side or and opposite from the newly activated feed element in the column, is de-activated or de-energized. This process continues for generating successive primary beams whereby immediately adjacent feed elements 64 in the particular column are turned on, while immediately adjacent oppositely located feed elements are turned off. With respect to scanning in the azimuth direction, a similar procedure is followed when the collimating member 32 has a two-dimensional configuration, such as a two-dimensional curved reflector or lens. In the case of a pillbox antenna array, on the other hand, since it is one-dimensional, a different procedure is required, such as one that involves a commutating network or control.

Figure 12:
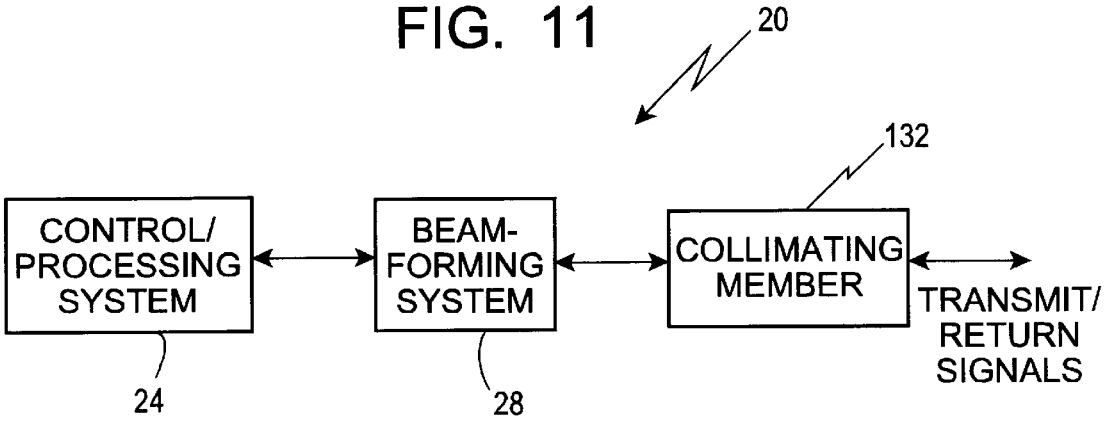
FIG. 12 is a block diagram of another embodiment of the antenna apparatus of the present invention in which waveguides are not employed.

Referring to FIG. 12, another embodiment of the antenna apparatus 20 is diagrammatically illustrated in which waveguides are not employed to guide the formed beams to the collimating member. In this embodiment, the beam-forming system 28 under control of the control/processing system 24 directly provides a primary beam to the collimating member 132, rather than being directed through one or more waveguides. Such an embodiment results in a reduction of parts and complexities, particularly when using the antenna apparatus in space since no waveguides need to be arranged or set up when the antenna apparatus is deployed. On the other hand, the length or longitudinal extent of the collimating member 132 is greater than that required when waveguides are utilized, such as in the embodiment of FIG. 1. Without the use of waveguides, when activating the feed elements of the beam-forming system 28, portions of the beam illumination may not strike the collimating member. This may result in an unacceptable transmit beam or signal. The length of the collimating member 132 should be selected to eliminate or practically overcome this potential drawback. With respect to the length of the collimating member, it is ascertained as a function of the focal length (f) of the collimating member 132, such as a reflector or lens, and the array length (AL) or width of the array of feed elements in the beam-forming system 28. More specifically, the length of the collimating member 132 is at least equal to the sum of the length of the array of feed elements and twice its focal length ($AL+2f\times Tan(\theta)$, where $\theta$ is the maximum scan angle).

A scanning transmit signal is not the only mode of operation since the antenna apparatus 20 allows for various modes of operation under control of the control/processing system 24 to energize a substantial number of combinations of feed elements 64 in both elevational and azimuth directions. Included among such modes of operation are the simultaneous generation of two or more primary beams. In that regard, two or more transmit signals can be output from the antenna apparatus 20 at the same time to obtain desired information that is received by the antenna apparatus 20 by means of their respective corresponding return signals. In this mode of operation, the same feed element 64 can be utilized in forming each of the two or more primary beams. In accordance with such an embodiment, the antenna apparatus 20 is able to generate appropriate primary beams that result in simultaneous transmit signals directed to cover the same general area on the earth's surface, but from different perspectives or directions. Such information from the two or more transmit signals may be useful in better describing or better identifying what is occurring or what is present at one or more locations or areas on the earth's surface.

A further aspect of control that can be utilized relates to regulating the size of the secondary beam that emanates from the collimating member 32, 132. In particular, by selective control of activation of the feed elements, the width of the secondary beam can be regulated. When it is desired or advantageous to produce a relatively narrow secondary beam, fewer feed elements are activated at the same time, such as no greater than 4 feed elements and in the range of 2–4 feed elements. When such a number of feed elements are simultaneously energized, a relatively wide primary beam is generated by such feed elements and directed to the collimating member 32, 132 from which a relatively narrow secondary beam is produced. Alternatively, a relatively narrow primary beam can be provided using the feed elements when a relatively greater number of them are activated, such as 8 or more feed elements being activated at the same time, or essentially the same time. The application of this narrow primary beam to the collimating member 32, 132 results in a relatively wide secondary beam being generated. A narrow secondary beam may be useful in providing a transmit signal of sufficient strength to receive a return signal from the object or area to which such a narrow secondary beam is transmitted. In the case of a wide secondary beam, this may be beneficial in connection with a receive signal or beam in which the antenna apparatus is essentially, passively monitoring emissions or signals, with no particular or predetermined signal being monitored, but rather monitoring a general or wider area associated with signal reception.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best modes presently known of practicing the inventions and to enable others skilled in the art to utilize the inventions in such, or in other embodiments, and with the various modifications required by their particular application or uses of the invention. It is intended that the appended claims be construed to include alternative embodiments to the extent permitted by the prior art.

What is claimed is:

1. An antenna apparatus, comprising:

a beam forming system that includes:

an array of feed elements including at least a first feed element for use in generating at least a first primary beam and a second primary beam, said array of feed elements also being used in generating at least a third primary beam and a fourth primary beam, said first primary beam being associated with a first azimuth position and a first amplitude;

a control system in communication with said array of feed elements, said first feed element being energized and being used in generating said first primary beam and said second primary beam, wherein said control system includes phase adjusting circuitry for use in causing said third primary beam to be in a second azimuth position different from said first azimuth position, said control system also including a plurality of transmit/receive (T/R) modules having at least a first variable gain amplifier operatively connected to at least said first feed element for use in causing said fourth primary beam to have a second amplitude different from a first amplitude of said first primary beam, with said fourth primary beam being in a second elevation position different from a first elevation position of said first primary beam; and a beam collimating system including a collimating member for receiving said first primary beam and providing a first secondary beam, based on said received first primary beam, that is output from the antenna apparatus as a first transmit signal, said collimating member receiving said first primary beam substantially through space from said array of feed elements and in which, when said first transmit signal is output from the antenna apparatus, at least one of said T/R modules is used in energizing said first feed element to generate said first primary beam and then said first primary beam is applied to said collimating member through said space.

2. An apparatus, as claimed in claim 1, wherein:

said first primary beam and said second primary beam are generated at substantially the same time.

3. An antenna apparatus, as claimed in claim 1, wherein:

said array of feed elements includes a second feed element and said control system includes scanning means for selecting a first plurality of said feed elements including said first feed element but not including said second feed element to generate said first primary beam and for selecting a second plurality of feed elements including said first and second feed elements to generate said second primary beam and in which said second feed element is immediately adjacent to said first feed element.

4. An antenna apparatus, as claimed in claim 3, wherein:

said array of feed elements includes a third feed element that is energized in generating said first primary beam but is de-activated when forming said second primary beam and in which said second and third feed elements are on opposing sides of said first feed element.

5. An antenna apparatus, as claimed in claim 1, wherein:

said array of feed elements includes a number of rows and a number of columns of feed elements including a first row, each said feed element in said first row being spaced from its immediately adjacent feed element by a distance of no greater than about one wavelength.

6. An antenna apparatus, as claimed in claim 5, wherein:

said distance is about 0.5 wavelength.

7. An antenna apparatus, as claimed in claim 1, wherein:

a majority of feed elements of said array of feed elements has a width dimension along a direction of a first row of said feed elements of about no greater than one wavelength.

8. An antenna apparatus, as claimed in claim 1, wherein:

each of said feed elements has a gain no greater than about 6 db.

9. An antenna apparatus, as claimed in claim 1, wherein:

said beam collimating system includes a collimating member having a height (D) and a focal length (f), which is defined between said collimating member and said array of feed elements and in which a ratio of f/D is no greater than about 1.5.

10. An antenna apparatus, as claimed in claim 9, wherein:

said f/D ratio is in the range of about 0.5–1.5.

11. An antenna apparatus, as claimed in claim 1, wherein:

said control means includes a plurality of transmit/receive modules in which the total number of said transmit/receive modules is less than the total number of feed elements.

12. An antenna apparatus, as claimed in claim 11, wherein:

the total number of said transmit/receive modules is less than ⅓ of the total number of said feed elements.

13. An antenna apparatus, as claimed in claim 11, wherein:

said control system further includes a switch elements network for providing communication between said first feed element and a selected one of said plurality of transmit/receive modules.

14. An antenna apparatus, as claimed in claim 13, wherein:

said switch elements network provides communication between a feed element, different from said first feed element, and said selected one of said plurality of transmit/receive modules.

15. An apparatus, as claimed in claim 1, wherein:

at least one of said feed elements is different from another of said feed elements.

16. An antenna apparatus, as claimed in claim 11, wherein:

said plurality of transmit/receive modules includes a first number of transmit modules and a second number of receive modules.

17. An antenna apparatus, as claimed in claim 1, wherein:

no more than 4 of said feed elements are activated at substantially the same time to provide said first primary beam and in which said first secondary beam is substantially wider than a secondary beam produced from a second primary beam, where said second primary beam is formed by activation of at least 8 feed elements at substantially the same time.

18. An antenna apparatus, as claimed in claim 1, wherein:

said collimating member has a curved configuration and said collimating member is selected from a group that includes a reflector, a parabolic reflector and a lens.

19. An antenna apparatus, as claimed in claim 1, wherein:

said beam collimating system includes a number of waveguides including a first waveguide defined by spaced first and second waveguide members, each of said first and second waveguide members having a first end and a second end, said beam collimating system further including a collimating member in electrical continuity with said second ends of said first and second waveguide members.

20. An antenna apparatus, as claimed in claim 16, wherein:

said array of feed elements has a number of rows and a number of columns including a first column and said first column being axially aligned with said first waveguide in which a width dimension of each of said feed elements of said first column is disposed between said first and second waveguide members.

21. A method for sending transmit signals, comprising:

providing a beam forming system including a plurality of feed elements and a beam collimating system of an antenna apparatus, said plurality of feed elements including a number of rows and a number of columns of feed elements including a first row to define an array of feed elements, each said feed element in said first row being spaced from its immediately adjacent feed element by distance of no greater than about one wavelength, a majority of said feed elements of said plurality of said feed elements has a width dimension along a direction of said first row of said feed elements of no greater than one wavelength, each of the a majority of said feed elements of said array of feed elements has a gain no greater than about 6 db, said beam collimating system including a collimating member having a height (D) and a focal length (f), which is defined between said collimating member and said array of feed elements, and in which a ratio of f/D is no greater than about 1.5;

supplying energy to at least first and second feed elements of said array of feed elements;

generating a first primary beam based on said step of supplying energy to said first and second feed elements;

developing a first secondary beam based on said first primary beam using said beam collimating system;

transmitting a first transmit signal based on said first secondary beam;

applying energy to at least said second feed element and a third feed element of said array of feed elements;

producing a secondary primary beam based on said step of applying energy to said second and third feed elements;

developing a secondary beam based on said second primary beam using said beam collimating system; and transmitting a second transmit signal based on said second secondary beam.

22. A method, as claimed in claim 21, wherein:

said generating step and said producing step are conducted at substantially the same time.

23. A method, as claimed in claim 21, further including:

discontinuing said supplying of energy to said first feed element close in time to said step of applying energy to said third feed element.

24. A method, as claimed in claim 21, further including:

providing a fourth feed element of said array of feed elements;

discontinuing said supplying of energy to said first and second feed elements;

delivering energy to said fourth feed element of said array of feed elements; and outputting a third primary beam based on at least said step of delivering energy to said fourth feed element.

25. A method, as claimed in claim 24, wherein:

said fourth feed element is immediately adjacent to said third feed element and said third feed element is immediately adjacent to said second feed element.

26. A method, as claimed in claim 21, wherein:

said beam collimating system includes at least a first waveguide and in which said first primary beam is guided by said first waveguide and in which said step of developing said first secondary beam includes contacting said collimating member by said first primary beam.

27. A method, as claimed in claim 21, wherein:

said array of feed elements includes a first column, said beam collimating system including a number of waveguides including a first waveguide and with said first column of said array of feed elements being aligned with said first waveguide.

28. A method, as claimed in claim 21, wherein:

said step of supplying energy to said first and second feed elements includes controlling a switch elements network connected to said plurality of feed elements.

29. A method, as claimed in claim 21, wherein:

said beam forming system includes a plurality of transmit/receive modules and said step of supplying energy to said first and second feed elements includes inputting an energizing signal to a switch elements network using at least one of said plurality of transmit/receive modules, wherein the total number of said transmit/receive modules is less than all of said feed elements used in the antenna apparatus.

30. A method, as claimed in claim 21, wherein:

said ratio of f/D being defined in the range of about 0.5–1.5.

31. A method, as claimed in claim 21, further including:

receiving a first return signal based on said first transmit signal by said beam collimating system and with said first return signal being applied to at least some of said array of feed elements.

32. A method, as claimed in claim 21, wherein:

said beam forming system includes a plurality of variable gain amplifiers and in which a plurality of additional primary beams are generated utilizing a first column of said array of feed elements by controlling amplitudes associated with said additional primary beams using said variable gain amplifiers.

33. A method, as claimed in claim 21, wherein:

said beam forming system includes phase adjusting circuitry and in which a plurality of additional primary beams are generated by scanning in azimuth using said phase adjusting circuitry.

* * * * *